US005151711A

United States Patent [19]

Taguchi

[11] Patent Number: 5,151,711

[45] Date of Patent: Sep. 29, 1992

[54] AUTOMOBILE ANTENNA AND METHOD OF MANUFACTURING THE SAME

[75] Inventor: Minoru Taguchi, Tokyo, Japan

[73] Assignee: Harada Industry Co., Ltd., Tokyo, Japan

[21] Appl. No.: 586,806

[22] Filed: Sep. 24, 1990

[30] Foreign Application Priority Data

Sep. 25, 1989 [JP] Japan ..... 1-248917
Apr. 16, 1990 [JP] Japan ..... 2-99641

[51] Int. Cl.[5] ..... H01Q 1/320; H01Q 1/270
[52] U.S. Cl. ..... 343/715; 343/DIG. 1
[58] Field of Search ..... 343/DIG. 1, 715, 900, 343/895

[56] References Cited

U.S. PATENT DOCUMENTS

| | | | |
|---|---|---|---|
| 4,160,979 | 7/1979 | Drewett | 343/895 |
| 4,163,981 | 8/1979 | Wilson | 343/715 |
| 4,379,298 | 4/1983 | Vincent et al. | 343/895 |
| 4,435,713 | 3/1964 | Gasparaitis et al. | 343/702 |
| 4,675,687 | 6/1987 | Elliot | 343/715 |

FOREIGN PATENT DOCUMENTS

| | | | |
|---|---|---|---|
| 2358277 | 6/1975 | Fed. Rep. of Germany | 343/715 |
| 2846344A1 | 5/1980 | Fed. Rep. of Germany . | |
| 3822664A1 | 2/1989 | Fed. Rep. of Germany . | |

OTHER PUBLICATIONS

Motorola Technical Disclosure Bulletin, vol. 6, No. 1, Oct. 1986, pp. 24-25, T. L. Higby et al., "High Frequency Whip Antenna (800 MHZ)".

*Primary Examiner*—Michael C. Wimer
*Assistant Examiner*—Peter Toby Brown
*Attorney, Agent, or Firm*—Holtz, Goodman & Woodward Frishauf

[57] ABSTRACT

An automobile antenna of a rod shape comprises an antenna element and a hollow cylindrical member of a resin fitted on the circumference of the antenna element. The hollow cylindrical member includes a plurality of hollow cylindrical units that may be coupled together or may be spaced apart. The cylindrical member has a ridge or ridges in the form of a spiral or ring. The ridge functions to generate a turbulent flow of air when the automobile runs at a high speed, so that a whistling sound generated by the wind blow may be eliminated. The method of making an antenna uses two offset molds having a plurality of cavities by the provision of spaced apart partitions, which also support the antenna element. A molding material is supplied into the cavities so that the ridges-bearing cylindrical member and the antenna element may be fabricated as one unit. Portions of the antenna element supported by the partitions, after molding operation, are exposed externally to attain an improved whistling sound elimination function.

5 Claims, 3 Drawing Sheets

AUTOMOBILE ANTENNA AND METHOD OF MANUFACTURING THE SAME

BACKGROUND OF THE INVENTION

1. Field of the Invention

This invention generally relates to an automobile antenna and, more particularly, to a rod-type automobile antenna provided with means for eliminating a whistling sound or noise generated during automobile driving operation and a method for manufacturing such an antenna.

2. Description of the Related Art

An antenna using a rod-shaped antenna element is most common for use with automobiles. An automobile antenna using such an antenna element generates a whistling sound or noise when the automobile runs at a high speed or when the non-running automobile is exposed to a strong wind. Such whistling sound is annoying to the occupants of the automobile. Various attempts have been made to eliminate the whistling sound. One attempt has been to streamline the cross section of the antenna element itself or a material covering the antenna element, to reduce its resistance to wind pressure and thereby to eliminate the whistling sound.

The process of streamlining the cross section of an antenna, however, is complex and costly. In addition, in order to reduce resistance to wind pressure at high efficiency, it has been necessary to precisely direct an apex of the streamlined cross-section towards the direction of the wind. The direction of wind blow, however, is not always constant so that directional adjustment has practically been next to impossible. This approach has resulted not only in difficulties in eliminating the whistling sound, but also, in the worst case, in an increase of the amount of the sound. For this reason, an automobile antenna having a streamlined cross section is not successfully used.

In recent years, the improved capabilities of automobiles have greatly reduced various noise generations and provided quiet surroundings w thin the automobile. This has caused noise generated by an antenna not to be ignorable. In particular, the popularity of automobile telephones has prompted the creation of a quiet atmosphere and the elimination of a source of noise generation is urgently needed. For the above reason, a technique associated with the elimination of a whistling sound of an antenna has again come to light.

SUMMARY OF THE INVENTION

This invention has been accomplished with the foregoing problem in mind and has for its object to provide an automobile antenna provided with means for effectively eliminating a whistling sound regardless of the direction of the wind, which is easy to manufacture at relatively low cost.

Another object of the invention is to provide a method for manufacturing an automobile antenna provided with means for eliminating a whistling sound, wherein a greatly reduced number of manufacturing steps is required, a hollow cylindrical member acting as the means for eliminating a whistling sound is rigidly secured to a rod antenna element without a rattle, and the antenna element is free of deformation during manufacture.

To accomplish the foregoing objects, the antenna according to this invention uses a hollow cylindrical member formed of a plurality of hollow cylindrical chips or units made of a resinous material such as ABS (ACRYLONITRIDE-BUTADIENE-STYRENE), and which has on its outer circumference a spiral ridge or ring-shaped ridges for generating a turbulent flow of air. The cylindrical member is fitted on a rod-shaped antenna element. In forming the cylindrical member, the cylindrical units may be coupled to each other or may be mounted with fixed spacings therebetween.

The ridge(s) in a spiral or ring shape functions to cause the wind hitting the outer circumference of the antenna to generate a relatively large amount of turbulent flows, so that low atmospheric pressure regions which tend to be produced locally at the circumference of the antenna on the lee side may be scattered and destroyed. As a result, small vibrations which are otherwise generated by the low pressure regions are suppressed, and the whistling sound is eliminated.

The size of the hollow cylindrical units may be optionally selected so as to be suited for molding, so that cylindrical units of a uniform quality may be produced on a mass production scale, thus providing for antennas at relatively low cost.

A plurality of the hollow cylindrical units for eliminating a turbulent flow may be fitted around the rod antenna element with spacings, to permit the antenna element to be partly exposed externally. The arrangement serves to more easily generate turbulent flows so that the elimination of whistling sound is more effectively achieved. Further, stresses on the antenna due to wind pressure can be distributed, so that it is possible to prevent stress from being concentratedly applied on the root portion of the antenna, and thus to prevent the antenna from being bent or broken.

The hollow cylindrical member may be formed by molding by use of a resinous material, which is not detrimental to the functions of an antenna. The material used is easy to process by molding and makes the entire weight of the antenna light.

The method for manufacturing an automobile antenna provided with means for eliminating a whistling sound according to this invention employs a split mold having a stationary mold segment and a movable mold segment of an offset construction. Each mold has a semi-circular recess, a groove or grooves formed in the inner wall of the recess which, together with a groove or grooves formed similarly in the recess of the other mold, correspond to a ridge or ridges to be finally formed, and semi-circular partitions mounted in the semi-circular recess with a predetermined spacing with respect to the longitudinal direction of the recess. Each partition has a semi-circular cutout in the central portion. When the two molds are combined, the cutouts in one mold and those of the other mold define a plurality of circular openings through which the antenna element is securely held in the molds during a molding operation. Further, the semi-circular partitions of one die and those of the other die form a plurality of spaced apart circular partition walls in such a manner that two adjacent circular walls define an independent cavity therebetween. A plurality of independent cavities are thus formed, into which a molding material is fed through feeding bores formed either one or both of the two molds.

According to this method, the hollow cylindrical member is formed around the antenna element as one unit, so that the number of the steps required for the manufacture of antennas may be greatly reduced in comparison with the antenna according to the foregoing embodiment wherein the cylindrical member or units are manufactured separately and thereafter fitted around the antenna element. In the foregoing embodiment, the cylindrical units are to be coupled to each other so that, from an aesthetic standpoint, the ridges formed on the respective cylindrical units are continuous to retain its spirality throughout the length of the antenna. This adjustment is unnecessary with an antenna produced by the above method. According to the above method, parting lines (projections formed at junctions by molding) may be directed to a fixed direction to obtain an optimum sound elimination effect, without any adjusting operation, so that fabrication processes are simplified. Further, since the antenna element and the surrounding member are rigidly secured without any gap therebetween, the antenna is free from rattling. During the molding operation, the antenna element is fixedly received in the openings formed in the partitions, so that no bending or deformation occurs where a supply of the molding material takes place at a high pressure.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
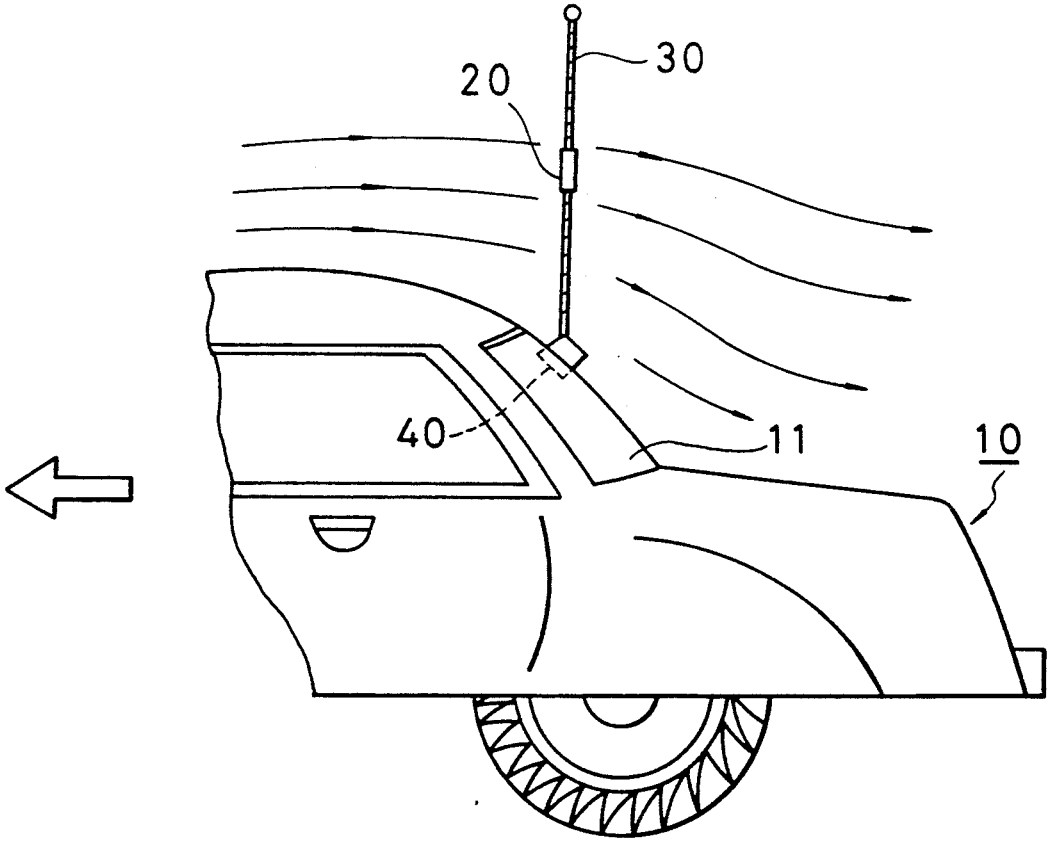
FIG. 1 is a schematic view of a rod antenna embodying this invention, as mounted on an automobile.

FIG. 1 is a schematic view showing an automobile antenna embodying this invention. As illustrated, an antenna 30 for microwave transmission and reception for an automobile telephone, provided with a phase coil 20, is mounted at a rear window 11 of an automobile body 10. The antenna 30 is secured at its bottom end to the rear window 11 in the vicinity of its upper edge. The antenna 30 is electrically connected to a transmitter/-receiver set within the automobile body via a coupling element 40 located within the automobile body.

Figure 2:
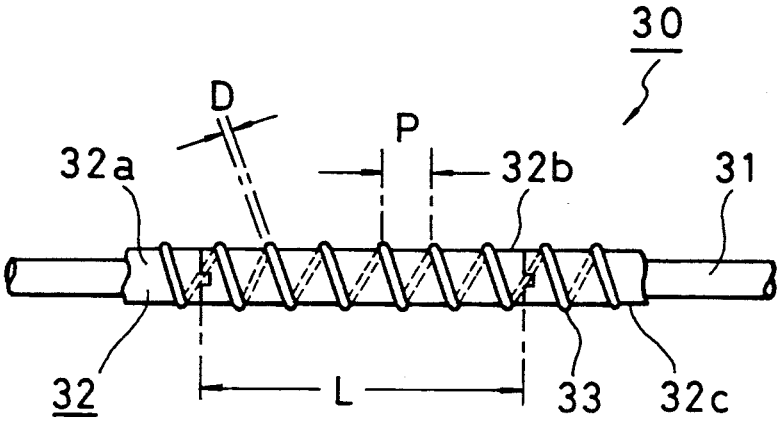
FIG. 2 is a side view of an essential part of an automobile antenna embodying this invention.
Figure 3:
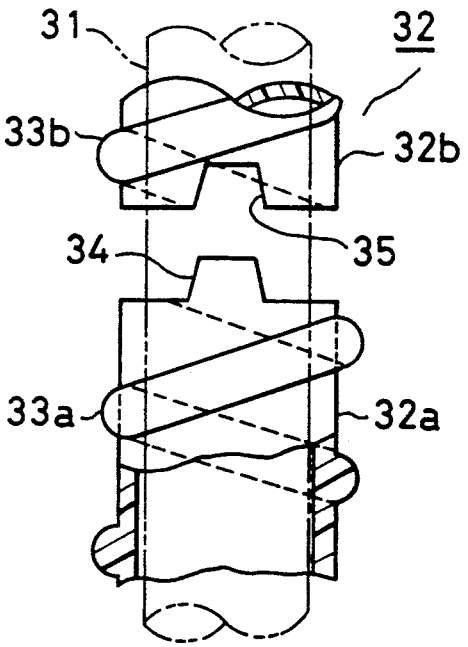
FIG. 3 is a side view, partly broken away, of cylindrical units according to this invention.

FIG. 2 is a side view of a portion, partly broken, of the antenna 30. FIG. 3 is a side view, partly broken, of a major portion of a hollow cylindrical member 32 which provides means for eliminating a whistling sound of the wind.

Figure 4:
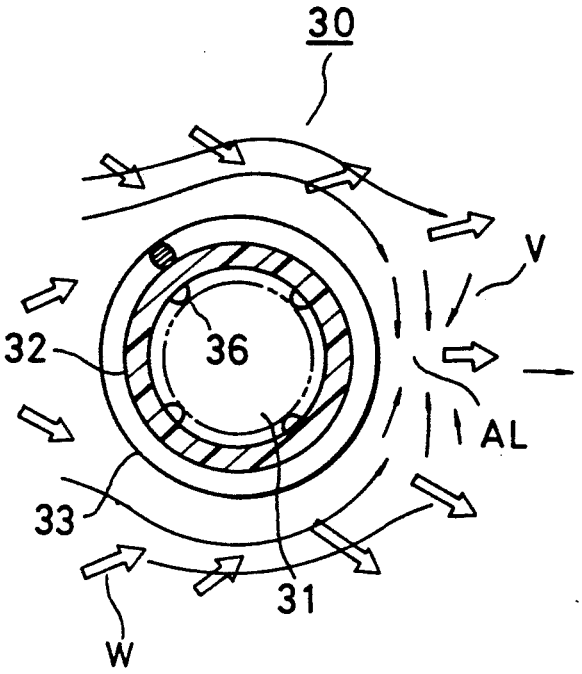
FIG. 4 is a cross section of the cylindrical unit shown in FIG. 3 to explain its function.

As shown in FIGS. 2 and 3, the antenna 30 has a structure in which a rod shaped antenna element 31 is fitted by a plurality of hollow cylindrical units 32 serving as a whistling sound absorber. The cylindrical member 32 is formed of a plurality of cylindrical units **32*a*, 32*b*, . . . each provided on its outer circumference with a spiral projection or ridge 33 for generating turbulence. As best shown in FIG. 3, each cylindrical unit 32*a* has a trapezoidal projection 34 at one end, which is received in a trapezoidal cutout 35 formed in the other end of an adjacent cylindrical unit, here 32*b*, whereby two adjacent cylindrical units are coupled. The positions of the projection 34 and the cutout 35 are predetermined such that when two adjacent cylindrical units 32*a* and 32*b* are coupled, the spiral ridge 33*a* is continuous with the spiral ridge 33*b*. The cylindrical units 32*a*, 32*b*, . . . are formed of a resin, such as ABS. Any clearance between the outer circumference of the antenna element 31 and the cylindrical member 32 results in unsteady amounting of the cylindrical member 32. To avoid this, a plurality of parallel ridges 36 are provided on the inner wall of the cylindrical member 32 as shown in FIG. 4, and extend in the longitudinal direction of the cylindrical member 32. Instead of using the parallel ridges, an adhesive may be used for this purpose to rigidly secure the cylindrical member 32 and the antenna element 31**.

When the antenna element 31 has a diameter of about 2 cm, it is preferable that the length of the cylindrical unit **32*a*, 32*b*, . . . is about 30 mm, the thickness "D" of the spiral projection or ridge 33** is about 1 mm, and the pitch P of the spiral ridge is about 5 mm. The invention of course is not limited to those values.

The function of the embodiment according to this invention will now be described.

When the automobile 10 runs at a high speed, low pressure regions AL tend to be locally created as shown in FIG. 4 at the outer circumference of the antenna 30 on the lee side. If those regions AL are created, the surrounding air spins as shown in thin arrows V in FIG. 4 and flows into the low atmospheric pressure regions AL, whereby small vibrations occur mainly in the forward/backward direction of the antenna 30 to create a whistling sound or noise.

Since the antenna 30 according to the embodiment of this invention has a structure in which the cylindrical member 32 provided with the spiral ridge 33 for generating a turbulent flow is mounted around the outer circumference of the antenna element 31, a relatively large amount of turbulence, indicated by large arrows W in FIG. 4, is generated by the wind hitting the outer circumference of the antenna by the action of the spiral ridge 33. The low atmospheric pressure regions AL to be locally generated at the antenna 30 on the lee side is affected by the turbulence and scattered. As a result, small vibrations of the antenna 30 due to the creation of the low atmospheric pressure regions Al is suppressed and hence the whistling sound is diminished.

The cylindrical units **32*a*, 32*b***, . . . may be set to a desired length suitable for molding, i.e., 30 mm, so that deformation of the cylindrical units such as by distortion during the molding process can be avoided. The above assists in manufacturing cylindrical units of uniform and stable characteristics, in comparison with the use of a single long cylindrical unit. This technique permits cylindrical units to be produced on a mass production scale in uniform quantity and at reasonable cost.

Since the cylindrical member 32 is formed of a resinous material, such as ABS, by molding, so that when it is used with the antenna element 31, it is not detrimental to the function of the antenna. The cylindrical member 32 according to this invention is easy to manufacture by molding and is light.

Another embodiment of the invention will be described with reference to FIG. 5 and onwards.

Figure 5:
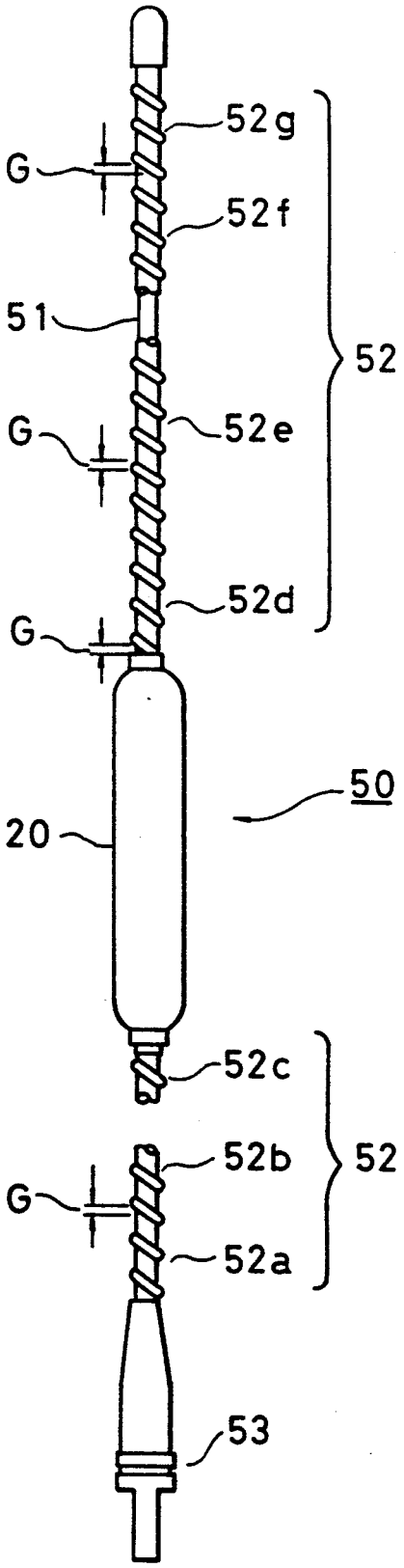
FIG. 5 is a side view, partly broken away, of an automobile antenna according to a second embodiment of the invention.

FIG. 5 is a side view of an antenna 50 according to the second embodiment of the invention. Reference numeral 51 indicates a rod antenna element, 52 a cylindrical member providing for means to eliminate a whistling sound, and 53 a joint for mounting the antenna. The basic difference between the first embodiment and this second embodiment resides in the structure of the cylindrical member 52. As shown, the cylindrical member 52 has a structure wherein a plurality of cylindrical units 52*a*, 52*b*, . . . are formed on the outer circumference of a rod antenna element 51 by molding as one unit, the cylindrical units 52*a*, 52*b*, . . . having a predetermined spacing G therebetween. In the embodiment shown, the rod antenna element 51 is partly exposed externally between the cylindrical units 52*a*, 52*b*, . . . This arrangement permits turbulence to be more easily generated, so that the effect of eliminating the whistling sound is further improved. Further, stresses given on the antenna due to wind pressure are scattered to cause vibrations to be likewise scattered and diminished, with the result that concentration of stress onto a joint 53 portion of the antenna 50 may be avoided, and the antenna 50 is prevented from being bent or broken at the joint 53 portion.

Figure 6:
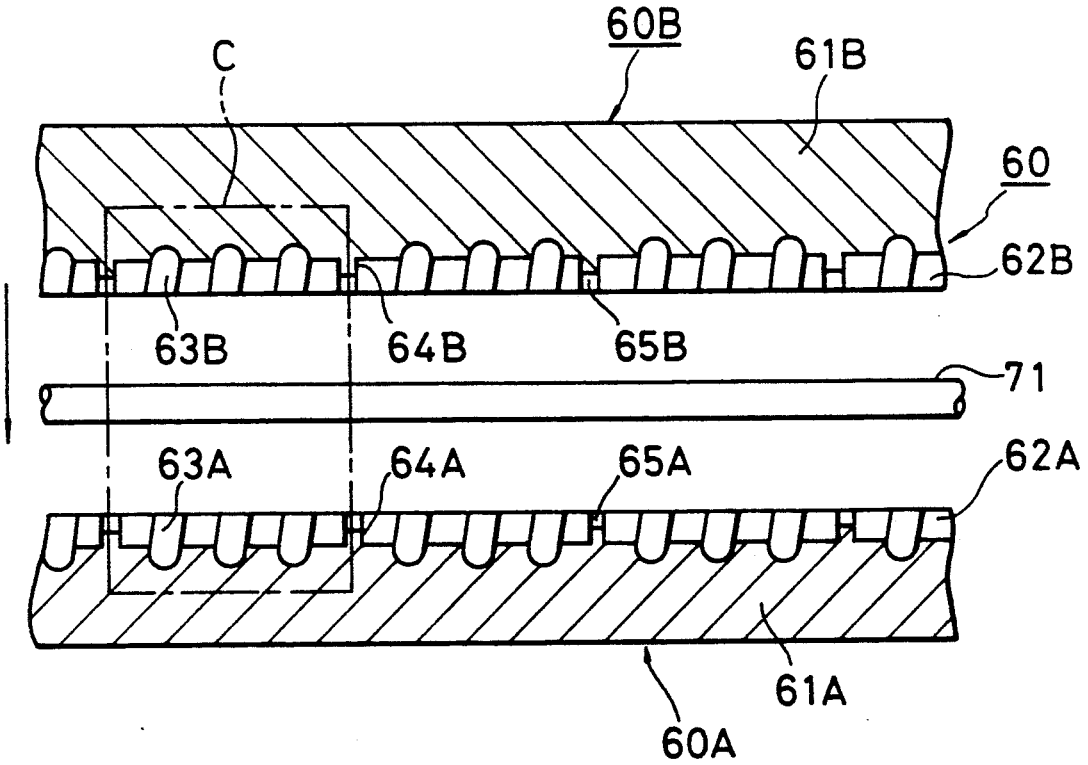
FIG. 6 is a cross section of part of a mold used for the manufacture of an antenna according to this invention.
Figure 7:
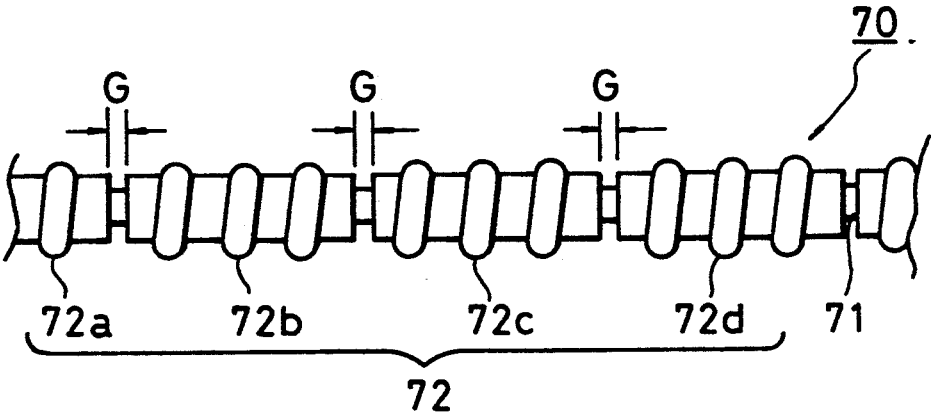
FIG. 7 is a side view of an essential part of an automobile antenna manufactured by a method according to this invention.

Referring to FIGS. 6 and 7, a third embodiment of the invention will be described which covers a method of manufacturing an antenna 70 having a similar structure as the antenna 50 of FIG. 5.

FIG. 6 is a cross section of major parts of molds 60 and a rod antenna element 71. Numeral 60A indicates a stationary mold segment and 60B a movable mold segment. These molds 60A and 60B have a substantially identical offset construction. The stationary mold 60A will therefore be described to explain the structures of both of the molds.

In one side of a mold base 61A is formed a semi-cylindrical recess 62A, in the inner circumference of which in turn is formed a spiral groove 63A. Within the recess 62A of the semi-cylindrical recess 62A are mounted a plurality of semi-circular partitions 64A which are spaced from each other with a predetermined spacing in the axial direction of the recess 62A, the upper central edge of the semi-circular partitions 64A each being cut away to define semi-circular cut portions 65A for holding the rod antenna element 71 in position. The movable mold 60B has a similar offset construction.

An automobile antenna with a whistling sound eliminating function according to this invention may be manufactured in the following manner.

First, the rod antenna element 71 is placed in the stationary mold so as to be received in the semi-circular cut portions 65A.

Second, the movable mold 60B is placed upon the stationary mold 60A as indicated by an arrow in FIG. 6, with the antenna element 71 rigidly held in position within the molds by being received in circular openings defined by the semi-circular cut portions 65A and 65B. In this closed state, a plurality of independent cavities are formed which are defined by two adjacent partitions 64A of the stationary die 60A and two corresponding adjacent partitions 64B of the movable die 60B, such as a region C indicated by dot-chain lines in the figure.

Feeding holes (not shown) are formed in at least one of the two molds so that they communicate with the interior of the cavities, and a molding material, such as a resinous material, is fed into the cavities through the feeder holes for molding.

FIG. 7 illustrates an essential part of an automobile antenna 70 provided with a plurality of hollow cylindrical units 72*a*, 72*b*, . . . for eliminating the whistling sound, which is manufactured according to the foregoing method.

Since the antenna element 71 and the cylindrical member 72 formed of a plurality of cylindrical units 72*a*, 72*b*, . . . are formed as one unit by molding, the number of manufacturing steps is greatly reduced comparing with an antenna in which the antenna element and the cylindrical units are separately manufactured and secured together after the cylindrical units are fitted around the antenna element. Where, as in the first embodiment, a plurality of cylindrical units or chips 72*a*, 72*b*, . . . are manufactured separately of the rod antenna element 71 and thereafter fitted round the antenna element 71, it is desirable that the positions of the cylindrical units are adjusted for the purpose of forming a continuous spirality so as not to damage the aesthetical appearance of the antenna. Such adjustment is not required when an antenna is manufactured according to the foregoing method. Further, according to the foregoing method, no gaps are present between the rod antenna element 71 and the cylindrical member 72, so that no rattling sound is produced. Since the rod antenna element 71 in the molding process is rigidly supported by the partitions 64A and 64B arranged within the molds 60 with predetermined spacings, the rod antenna element 71 is free of deformation even if the molding material is fed into the cavities at a high pressure.

This invention is not limited to the foregoing embodiments. For example, the spiral ridge formed on the antenna element may be replaced by ridges in the form of a ring or by other types of ridges that may effectively generate turbulence. For example, non-spiral ridges which are ring shaped but which extend in a direction not perpendicular to the axis of the antenna element may be used.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An automobile antenna comprising:

a flexible rod antenna element having a longitudinal axis;

a plurality of independent identical cylindrical members, each having a first and a second end portion, said plurality of cylindrical members being mounted around the rod antenna element and in spaced-apart relation along the longitudinal axis of the rod antenna element so that a plurality of gaps are provided between adjacent ones of the first and second end portions of the plurality of identical cylindrical members, said gaps enabling the rod antenna element to flex without hinderance from said plurality of identical cylindrical members mounted thereon; and each of said plurality of identical cylindrical members having an outer surface and having a given length along a longitudinal axis thereof;

air turbulence generating means formed integrally on said outer surface of each of said cylindrical members along a substantial portion of said given length of each of said cylindrical members;

said air turbulence generating means comprising ridges projecting from said outer surface of each of said cylindrical members; and each of said cylindrical members comprising a resinous material; and said gaps between adjacent cylindrical members generating additional air turbulence.

2. The automobile antenna according to claim 1, wherein the resinous material comprises acrylonitrile-butadiene-styrene.

3. An automobile antenna which substantially reduces wind noise generated as wind moves past the antenna, the wind creating a reduced pressure area behind the antenna when viewed from a direction in which the wind is moving, said automobile antenna comprising:

a flexible rod antenna element having a longitudinal axis;

a plurality of independent identical cylindrical members, each having a first and a second end portion, said plurality of cylindrical members being mounted around the rod antenna element in spaced-apart relation along the longitudinal axis of the rod antenna element so that a plurality of gaps are formed between adjacent ones of the first and second end portions of the plurality of identical cylindrical members, said gaps enabling the rod antenna element to flex without hinderance from said plurality of identical cylindrical members mounted thereon; and each of said plurality of identical cylindrical members having an outer surface and having a given length along a longitudinal axis thereof;

air turbulence generating means formed integrally on and projecting from said outer surface of each of said cylindrical members along a substantial portion of said given length of each of said cylindrical members for generating air turbulence around said antenna, said gaps between adjacent cylindrical members also generating air turbulence;

the thus generated air turbulence substantially eliminating the reduced pressure area formed behind the antenna, thereby substantially reducing the wind noise.

4. The automobile antenna according to claim 3, wherein said air turbulence generating means comprises:

ridges projecting from said outer surface of each of said cylindrical members; and each of said cylindrical members comprising a resinous material.

5. The automobile antenna according to claim 4, wherein the resinous material comprises acrylonitrile-butadiene-styrene.

* * * * *